US008961124B2

(12) United States Patent
Fukuda et al.

(10) Patent No.: US 8,961,124 B2
(45) Date of Patent: Feb. 24, 2015

(54) AXIAL FAN

(75) Inventors: Takako Fukuda, Nagano (JP); Masaki Ogushi, Nagano (JP); Yoichi Kawai, Tokyo (JP); Naoya Ohki, Tokyo (JP)

(73) Assignee: Minebea Co., Ltd., Nagano (JP)

( * ) Notice: Subject to any disclaimer, the term of this patent is extended or adjusted under 35 U.S.C. 154(b) by 754 days.

(21) Appl. No.: 13/091,757

(22) Filed: Apr. 21, 2011

(65) Prior Publication Data

US 2011/0262271 A1 Oct. 27, 2011

(30) Foreign Application Priority Data

Apr. 27, 2010 (JP) ..... 2010-102000
Nov. 26, 2010 (JP) ..... 2010-263086

(51) Int. Cl.
*F04D 29/38* (2006.01)
*F04D 29/54* (2006.01)

(52) U.S. Cl.
CPC ..... *F04D 29/384* (2013.01); *Y10S 416/02* (2013.01)
USPC ..... 415/208.5; 415/207; 415/222; 415/223; 415/213.1; 416/223 R; 416/238; 416/DIG. 2

(58) Field of Classification Search
CPC ..... F04D 3/00; F04D 3/005; F04D 19/002; F04D 29/181; F04D 29/40; F04D 29/44; F04D 29/52; F04D 29/526; F04D 29/54; F04D 29/545; F04D 29/547; F04D 29/384; F04D 29/541; F04D 29/542
USPC ..... 415/222, 182.1, 220, 213.1, 207, 223 R, 415/234, 237, DIG. 2, 223, 208.3, 208.5; 416/223 R, 234, 237, 238, DIG. 2
See application file for complete search history.

(56) References Cited

U.S. PATENT DOCUMENTS

| | | | | |
|---|---|---|---|---|
| 3,334,807 | A * | 8/1967 | McMahan | 415/207 |
| 3,574,480 | A * | 4/1971 | Hoepfner | 415/211.1 |
| 2002/0094271 | A1* | 7/2002 | Yeuan et al. | 415/208.2 |
| 2002/0182071 | A1* | 12/2002 | Belady | 415/220 |
| 2006/0193724 | A1* | 8/2006 | Liu | 415/220 |
| 2008/0213103 | A1 | 9/2008 | Miyakoda et al. | |
| 2009/0175720 | A1* | 7/2009 | Yoshida et al. | 415/213.1 |

FOREIGN PATENT DOCUMENTS

| | | | |
|---|---|---|---|
| JP | 8-303391 | A | 11/1996 |
| JP | 2702755 | B2 * | 10/1997 |
| JP | 2004-251179 | A | 9/2004 |
| JP | 2007-198327 | A | 8/2007 |
| JP | 2008-215150 | A | 9/2008 |

OTHER PUBLICATIONS

Japanese Office Action issued on Sep. 2, 2014 in the corresponding JP patent application No. 2010-263086.

* cited by examiner

*Primary Examiner* — Christopher Verdier
(74) *Attorney, Agent, or Firm* — Carrier Blackman & Associates, P.C.; Joseph P. Carrier; Fulchand P. Shende

(57) ABSTRACT

An axial fan is provided. The axial fan includes a hub, an impeller having a plurality of blades mounted on an outer peripheral surface of the hub, and a housing surrounding the impeller. Each of the blades has a front edge angle (α) within a range of −8° to −20°, a mounting angle (β) within a range of 36° to 50°, and a twisted angle (θ) within a range of 10°±2°.

4 Claims, 7 Drawing Sheets

AXIAL FAN

BACKGROUND OF THE INVENTION

1. Field of the Invention

The present invention relates to an axial fan, and more particularly, to an axial fan that is used to cool an electronic device and the like.

2. Description of the Related Art

For example, in electronic devices such as a personal computer, a copier and the like, a plurality of electronic parts is housed in a relatively small casing. Therefore, heat that is generated from the electronic parts is confined in the casing, so that the electronic parts can be thermally destroyed, which causes considerable problems. Accordingly, vent holes are formed in a wall surface or ceiling surface of the casing of the electronic device, so that the heat in the casing is radiated through the vent holes. In the meantime, an axial fan is used as a cooling means of the electronic device. The axial fan for cooling the electronic device is required to reduce noise as much as possible and to improve an air volume (flow rate) performance. In order to improve the air volume performance, a shape of a blade or housing structure has been optimized.

For example, JP-A-H8-303391 describes an axial fan which reduces the noise by optimizing a shape of the blade.

FIG. 13 is a front view showing an axial fan described in JP-A-H8-303391 and FIG. 14 is a sectional view taken along a line B-B of FIG. 13. Blades 1 are radially provided on an outer peripheral surface of a cylindrical hub 2 of an impeller, so that the impeller configures so-called forward-swept blades. Specifically, the impeller is configured such that a mounting angle θ of a blade cross section becomes the maximum at near 70% of a diameter of the impeller. According to this configuration, a boundary layer on a negative pressure surface is blown off so as to reduce a vortex, so that noise can be reduced.

However, recently, as the electronic parts become densified and highly efficient, the amount of heat generated from the electronic parts also increases. Accordingly, an axial fan that is used to cool the electronic device having the electronic parts housed therein is required not only to reduce the noise but also to have a large air volume and a high static pressure and to improve the flow rate characteristic.

SUMMARY OF THE INVENTION

The present invention has been made in view of the above problems, and it is an aspect of the present invention to provide an axial fan having an improved flow rate characteristic by improving a blade shape of the axial fan.

The inventors made close study on a relation between a shape of a blade and an flow rate characteristic of an axial fan. As a result, it was found that the flow rate characteristic of the axial fan could be further improved by changing a shape of an impeller, particularly the shape of the blade.

According to an illustrative embodiment of the present invention, there is provided an axial fan comprising: a hub; an impeller having a plurality of blades mounted on an outer peripheral surface of the hub; and a housing surrounding the impeller. Each of the blades has a front edge angle (α) within a range of −8° to −20°, a mounting angle (β) within a range of 36° to 50°, and a twisted angle (θ) within a range of 10°±2°.

According to the above configuration, it is possible to provide an axial fan having the stable and improved static pressure—flow rate characteristic and capable of improving the static pressure—flow rate characteristic.

In the above axial fan, in each of the blades, the front edge angle may be within a range of −15° to −20°, the mounting angle (β) may be within a range of 38° to 50° and the twisted angle (θ) may be within a range of 10°±2°.

According to the above configuration, it is possible to provide an axial fan capable of further improving the static pressure—flow rate characteristic without deteriorating it due to a surging phenomenon and the like.

In addition, in the above axial fan, the housing may include: a cylindrical casing; flanges integrally formed at both ends of the cylindrical casing; and a motor base. The cylindrical casing may have an inner wall surface extending from an inlet port toward an outlet port, the inner wall surface including: curved surfaces at positions corresponding to corner parts of the flanges in an inlet port side, each of the curved surfaces being configured by round surfaces at two positions; curved surfaces at positions corresponding to the corner parts of the flanges in an outlet port side, each of the curved surfaces being configured by a round surface; and inclined surfaces at a center part between the inlet port side and the outlet port side.

According to the above configuration, it is possible to improve the flow rate characteristic by gently guiding the air of the inlet port into the cylindrical casing and guiding the air having passed through the cylindrical casing toward the outlet port.

In addition, in the above axial fan, the cylindrical casing may have a plurality of spokes that are connected with the motor base at an outlet port. The plurality of spokes may be arranged at a regular interval in a circumferential direction, each having a cross section of a blade shape and being inclined at a predetermined angle.

According to the above configuration, it is possible to improve the flow rate characteristic by guiding the air having passed through the cylindrical casing toward the outlet port and by increasing the pressure at the outlet port.

In addition, in the above axial fan, the cylindrical casing may have a sidewall formed with a slit or a hole.

According to the above configuration, since it is possible to use, as the inlet port, the slit or the hole formed in the sidewall of the cylindrical casing, it is possible to further increase the air volume.

DETAILED DESCRIPTION

Figure 1:
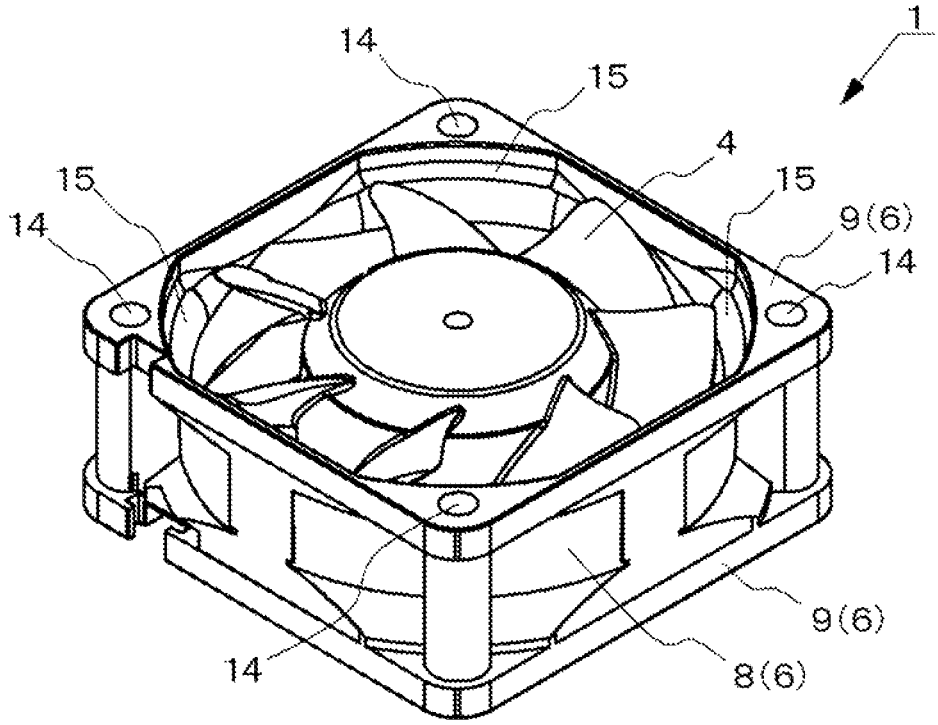
FIG. 1 is a perspective view showing an axial fan according to an illustrative embodiment of the present invention.
Figure 2:
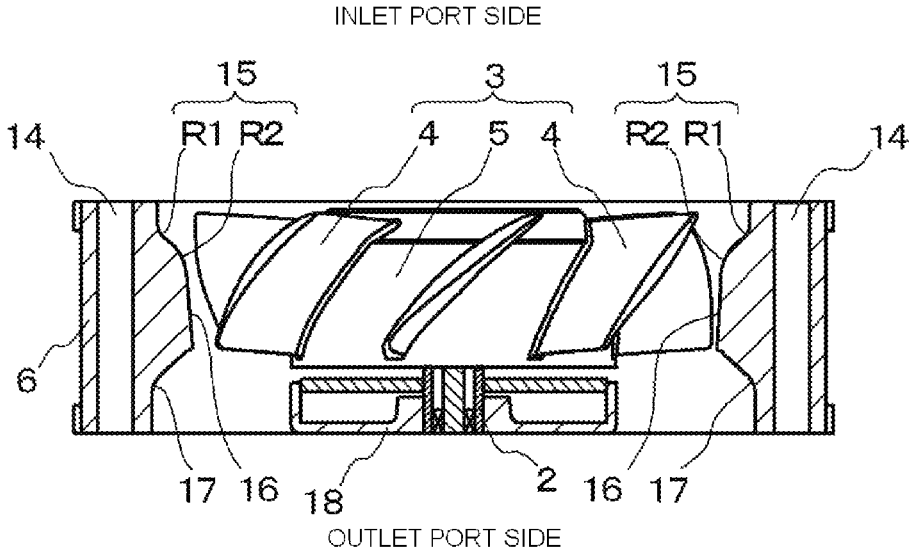
FIG. 2 is a sectional view of the axial fan shown in FIG. 1.
Figure 3:
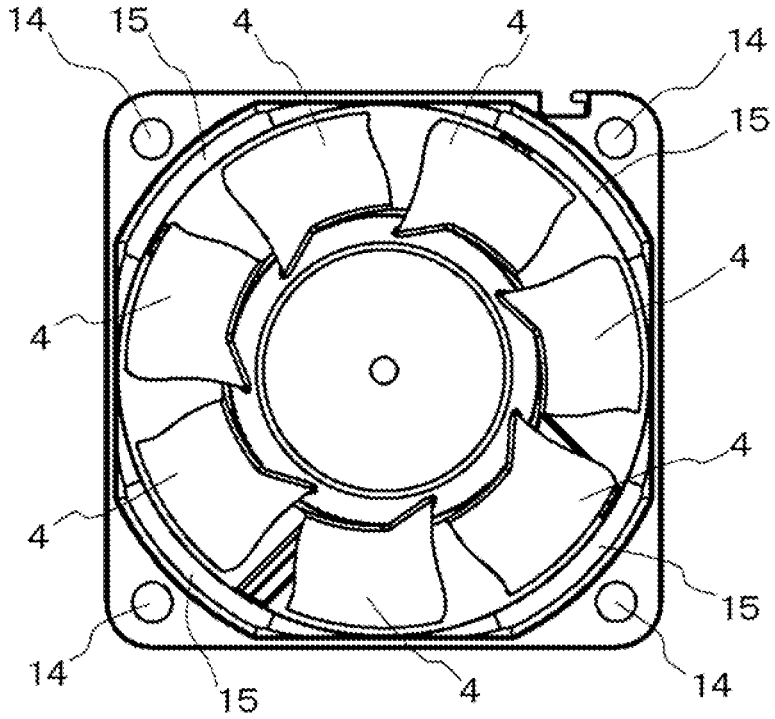
FIG. 3 is a plan view seen from an inlet side of the axial fan shown in FIG. 1.
Figure 4:
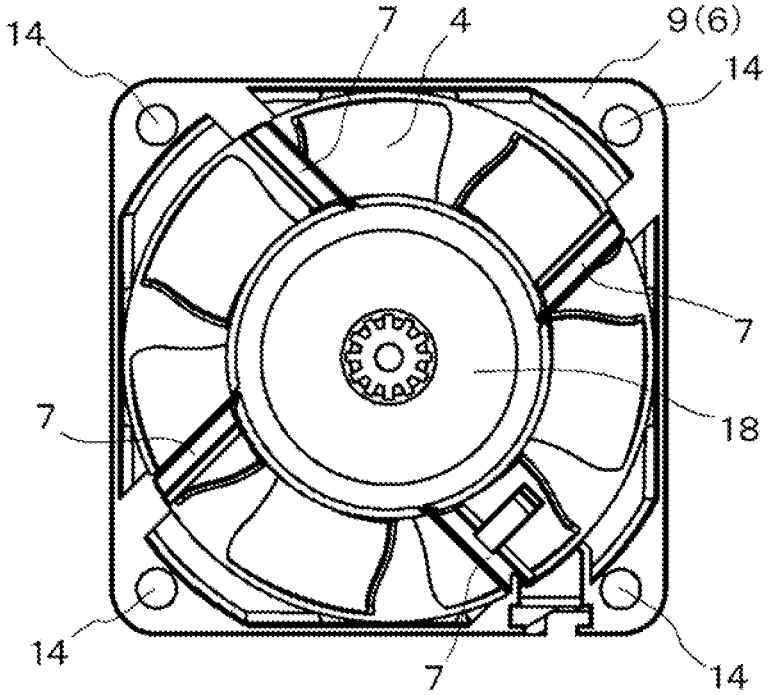
FIG. 4 is a bottom view of the axial fan shown in FIG. 1.
Figure 5:
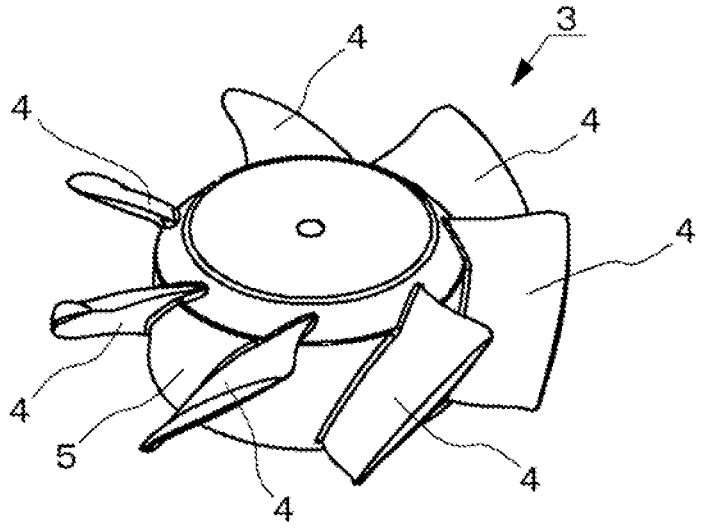
FIG. 5 is a perspective view of an impeller shown in FIG. 1.
Figure 6:
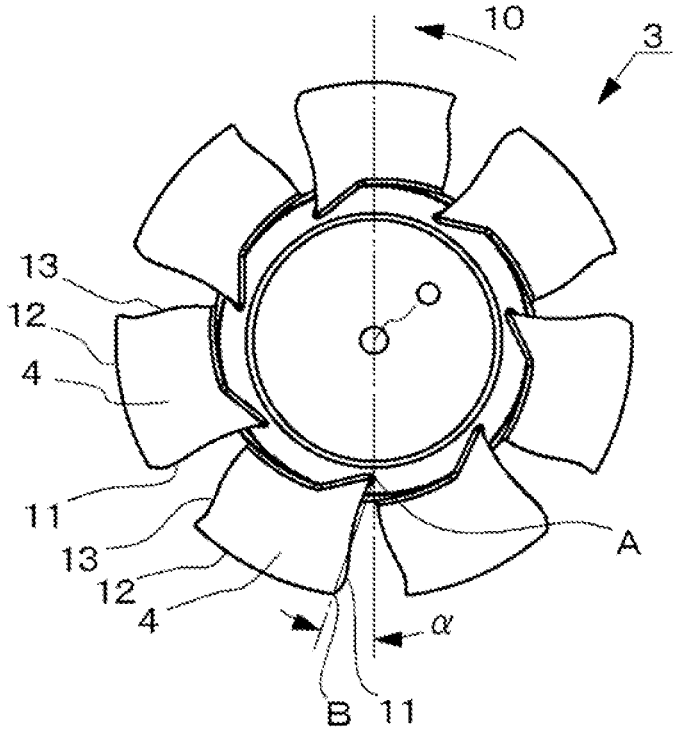
FIG. 6 is a plan view of the impeller shown in FIG. 5, which illustrates a front edge angle of a blade.
Figure 7:
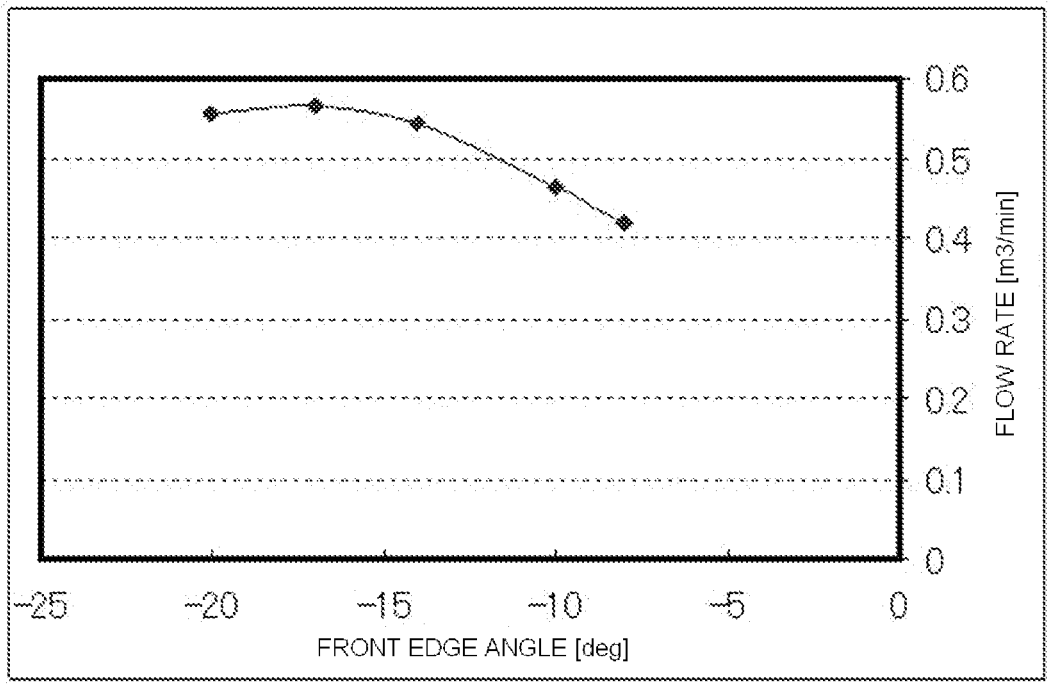
FIG. 7 illustrates a relation between the front edge angle of the blade and a flow rate.
Figure 8:
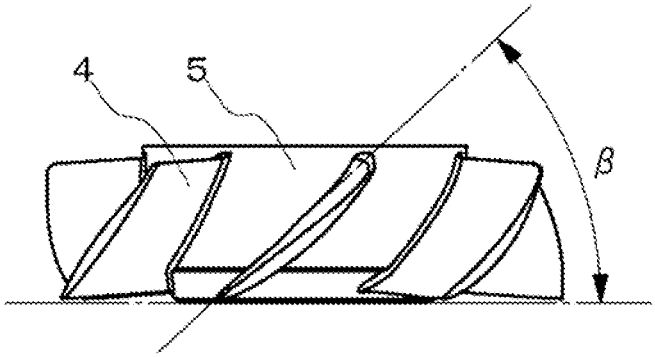
FIG. 8 is a side view of the impeller shown in FIG. 5, which illustrates a mounting angle of a blade.
Figure 9:
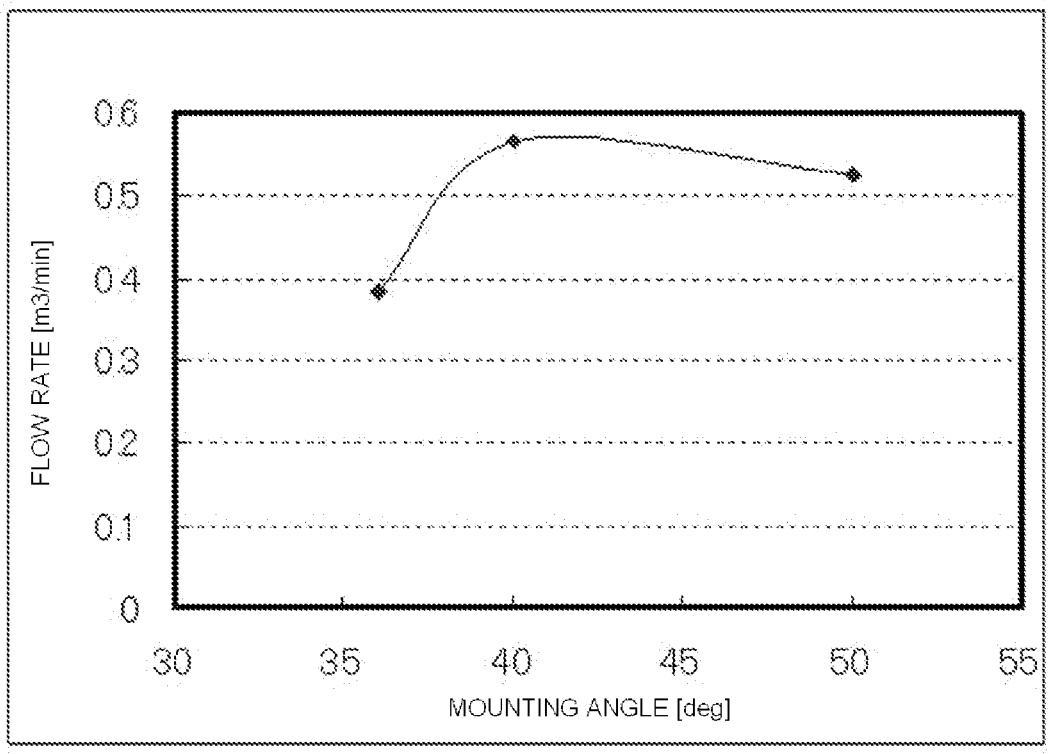
FIG. 9 illustrates a relation between the mounting angle of the blade and a flow rate.
Figure 10:
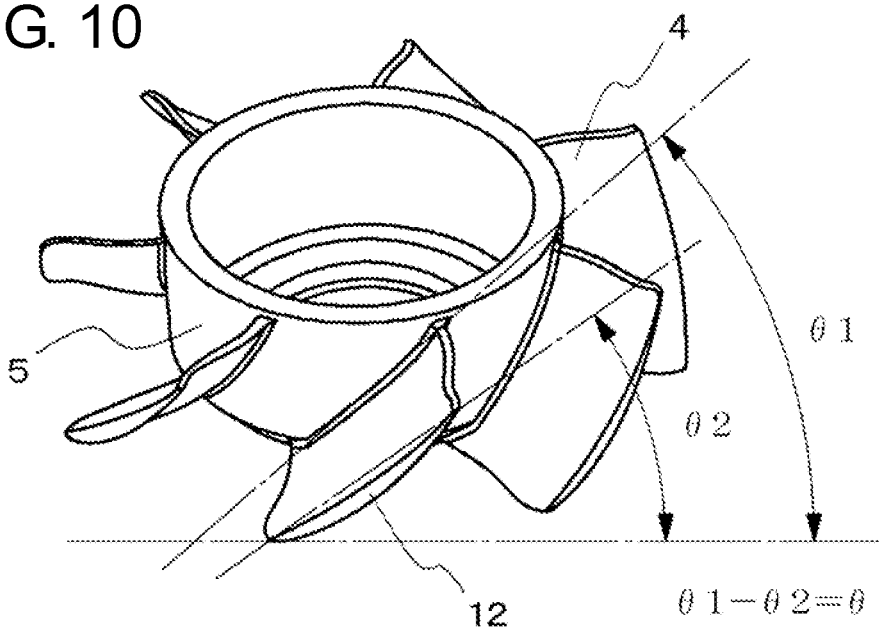
FIG. 10 illustrates a twisted angle of a blade.
Figure 11:
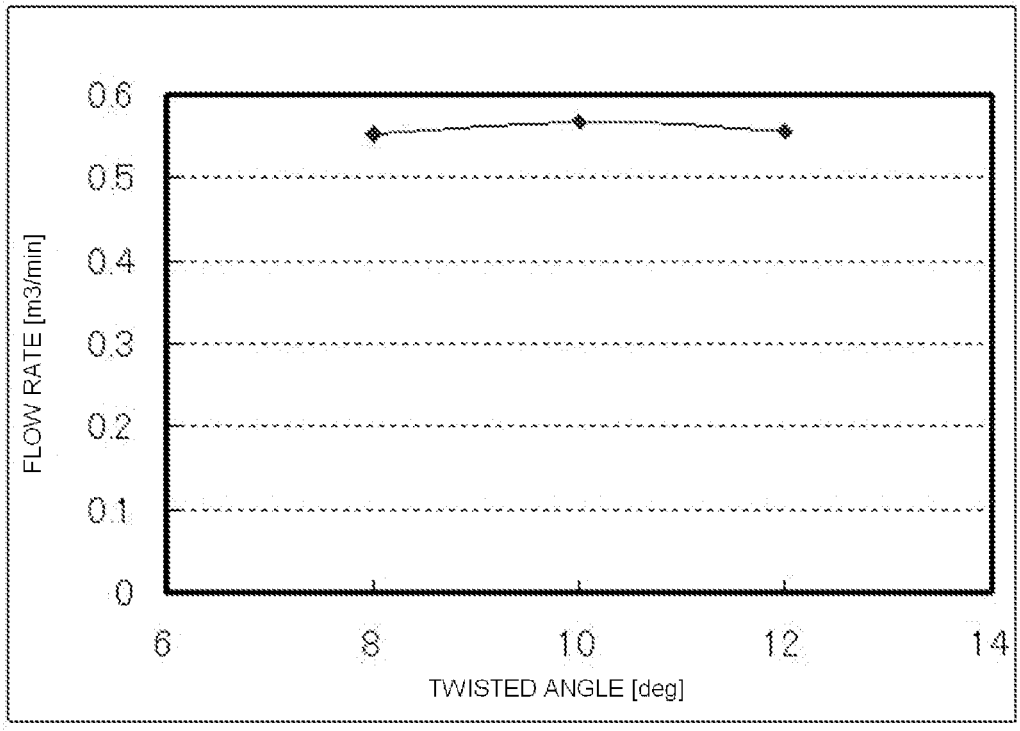
FIG. 11 illustrates a relation between the twisted angle of the blade and a flow rate.

Hereinafter, illustrative embodiments of the present invention will be described with reference to the drawings. FIG. 1 is a perspective view showing an axial fan according to an illustrative embodiment of the present invention, FIG. 2 is a sectional view of FIG. 1, FIG. 3 is a plan view seen from an inlet side of the axial fan shown in FIG. 1, FIG. 4 is a bottom view of the axial fan shown in FIG. 1, FIG. 5 is a perspective view of an impeller shown in FIG. 1, FIG. 6 is a plan view of the impeller shown in FIG. 5, which illustrates a front-edge angle of a blade, FIG. 7 illustrates a relation between the front-edge angle of the blade and a flow rate, FIG. 8 is a side view of the impeller shown in FIG. 5, which illustrates a mounting angle of a blade, FIG. 9 illustrates a relation between the mounting angle of the blade and a flow rate, FIG. 10 illustrates a twisted angle of a blade and FIG. 11 illustrates a relation between the twisted angle of the blade and a flow rate. It is noted that FIGS. 7, 9 and 11 show results of a simulation in which flow rates at an outlet port are calculated by an analysis using a finite volume method, when the number of revolutions is constant 4,600 rpm and the static pressure is 10 Pa. The consistency of simulation values and actual measured values are checked.

An axial fan 1 has a motor 2 to which an impeller 3 having a plurality of blades 4 are mounted, and a housing 6 that supports the motor 2. The motor 2 is fixed to the housing 6 by a plurality of spokes 7. The blades 4 are rotated by the motor 2. When the blades 4 are rotated as the motor 2 rotates, air is suctioned from an inlet port of the housing 6, passes through the inside of the housing 6 and is discharged from an outlet port of the housing 6.

The impeller 3 has a cylindrical hub 5 and the plurality of blades 4 that is mounted on an outer peripheral surface of the hub 5. The blades 4 (seven blades in this illustrative embodiment) are mounted at a regular interval in a circumferential direction. The blades 4 have the same shape and are integrally formed with the hub 5 by an injection molding of thermoplastic resin. An arrow 10 indicates a rotating direction of the blades 4.

A front edge angle (α) of the blade 4 is set within a range of −8° to −20°. Here, as shown in FIG. 6, the front edge angle (α) is an angle formed between a line connecting a center O of the hub 5 and an intersection A and a line connecting the intersection A and an intersection B. The intersection A is defined as an intersection between a front edge 11 of the blade 4 and the hub 5. The intersection B is defined as an intersection between the front edge 11 of the blade 4 and a blade end 12 of the blade 4. The symbol, minus (−), means that the intersection B is located at a further rear side, in the rotating direction, than the line connecting the center O of the hub 5 and the intersection A of the front edge 11 of the blade 4.

FIG. 7 illustrates a relation between the front edge angle (α) of the blade 4 and a flow rate, showing a result of a simulation in which flow rates at the outlet port are calculated by an analysis using a finite volume method, when the static pressure is 10 Pa. As shown in FIG. 7, when the front edge angle (α) of the blade 4 is varied within a range of −8° to −20°, the flow rate is decreased from the front edge angle (α) of about −15° as the front edge angle (α) is decreased (approaching 0°). In the meantime, the flow rate is little changed within the range of the front edge angle (α) of −15° to −20° and the maximum flow rate is obtained at the front edge angle (α) of about −17°. Accordingly, the front edge angle (α) of the blade 4 is set within the range of −8° to −20°, preferably −15° to −20°. Thereby, it is possible to suppress flow separation and to secure and maintain the high flow rate characteristic that is the maximum within the angle range.

In addition, a mounting angle (β) of the blade 4 is set within a range of 36° to 50°. As shown in FIG. 8, the mounting angle (β) of the blade 4 is an angle that is formed between a line connecting the front edge 11 of the blade 4 and a rear edge 13 of the blade 4 and a plane perpendicular to a rotational axial line, and that indicates a gradient angle with respect to the plane perpendicular to the rotational axial line. Here, the mounting angle (β) indicates an angle of the blade 4 at a base side (a mounting side to the hub 5).

FIG. 9 illustrates a relation between the mounting angle (β) of the blade 4 and a flow rate, showing a result of a simulation in which flow rates at the outlet port are calculated by an analysis using a finite volume method, when the front edge angle (α) of the blade 4 is 17° and the static pressure is 10 Pa. As shown in FIG. 9, when the mounting angle (β) of the blade 4 is smaller than about 40°, the blade 4 blocks the flow path of the fluid, so that the flow rate is decreased. On the other hand, when the mounting angle (β) of the blade 4 becomes larger, the flow rate is increased. Specifically, when the mounting angle (β) of the blade 4 is within a range of about 40° to 50°, the flow rate is little changed. The maximum flow rate is obtained when the mounting angle (β) of the blade 4 is about 40°. Accordingly, the mounting angle (β) of the blade 4 is set within a range of 36° to 50°, preferably 38° to 50°. Thereby, it is possible to increase the flow rate while the flow rate is little changed. In other words, it is possible to obtain high flow rate with little change (within the set range of 36° to 50° of mounting angle). In addition, when the mounting angle (β) of the blade 4 is made to be larger, a rotary torque of the motor 2 is increased, so that the power consumption of the motor 2 is increased and fan efficiency is thus decreased. Accordingly, it is preferable that the mounting angle (β) of the blade 4 is set around 40°.

In addition, a twisted angle (θ) of the blade is set within a range of 10°2°. As shown in FIG. 10, the twisted angle (θ) indicates a difference between a gradient angle (θ1) of the blade 4 at the base side (a mounting side to the hub 5) and a gradient angle (θ2) of the blade 4 at the blade end 12 (tip end of the blade).

FIG. 11 illustrates a relation between the twisted angle (θ) of the blade 4 and a flow rate, showing a result of a simulation in which flow rates at the outlet port are calculated by an analysis using a finite volume method, when the front edge angle (α) of the blade 4 is 17°, the mounting angle (β) is 40° and the static pressure is 10 Pa. As shown in FIG. 11, it is possible to increase the flow rate without decreasing the flow rate. In other words, it is possible to obtain high flow rate with no decrease (within the set range of 10°±2° of twisted angle).

The housing 6 has an outer appearance of a rectangular shape and includes a cylindrical casing 8, flanges 9, 9 that are integrally formed with both ends of the cylindrical casing 8, and a motor base 18 on which the motor 2 is mounted. The motor base 18 is connected to the housing 6 by the spokes 7. The cylindrical casing 8, the flanges 9, 9, the motor base 18 and the spokes 7 are integrally formed by the injection molding of thermoplastic resin.

The flanges 9 are formed at four corner parts thereof with through holes 14 for inserting bolts or screws so as to mount the axial fan to a device and the like.

The cylindrical casing 8 has an inner wall surface extending from the inlet port toward the outlet port. The inner wall surface at the inlet port side has four gentle curved surfaces 15 at positions corresponding to the four corner parts of the flanges. As shown in FIG. 2, each of the curved surfaces 15 is configured by round surfaces (R1, R2) at two positions. Further, the inner wall surface has a slightly inclined surface 16 at a center part thereof. A gap is formed between the outer peripheral surface of the blade 4 and the inner wall surface and is gradually decreased from the inlet port toward the outlet port.

In the meantime, the inner wall surface at the outlet port side has four gentle curved surfaces 17 at positions corresponding to the four corner parts of the flange. Each of the curved surfaces 17 is configured by a round surface, as shown in FIG. 2.

The motor base 18, which is mounted at a center part of the outlet port of the cylindrical casing 8, is connected and fixed to the outlet port side of the cylindrical casing 8 by the four spokes 7. The four spokes 7 are arranged at a regular interval in a circumferential direction. The four spokes 7 have a cross section of a blade shape and are inclined at a predetermined angle. The spokes 7 serve as guiding blades for guiding the air having passed the inside of the cylindrical casing 8 to the outlet port and increasing the pressure at the outlet port side.

The operation of the axial fan 1 is briefly described. Based on a signal from a control circuit, excitation current is supplied, so that a rotor of the motor 2 is rotated and the blades 4 are thus rotated. When the blades 4 are rotated, the air at the inlet port side of the cylindrical casing 8 is smoothly introduced into the cylindrical casing 8 along the curved surfaces 15 formed at the inlet port side. Then, the air introduced into the cylindrical casing 8 is guided by the blades 4 and along the inner wall surface having the inclined surface 16 and then passes through the inside of the casing 8. The air having passed through the inside of the casing 8 is smoothly discharged along the curved surfaces 17 formed at the outlet port side and is also discharged from the outlet port with being pressure-increased by the spokes 7 having a blade shape.

Figure 12:
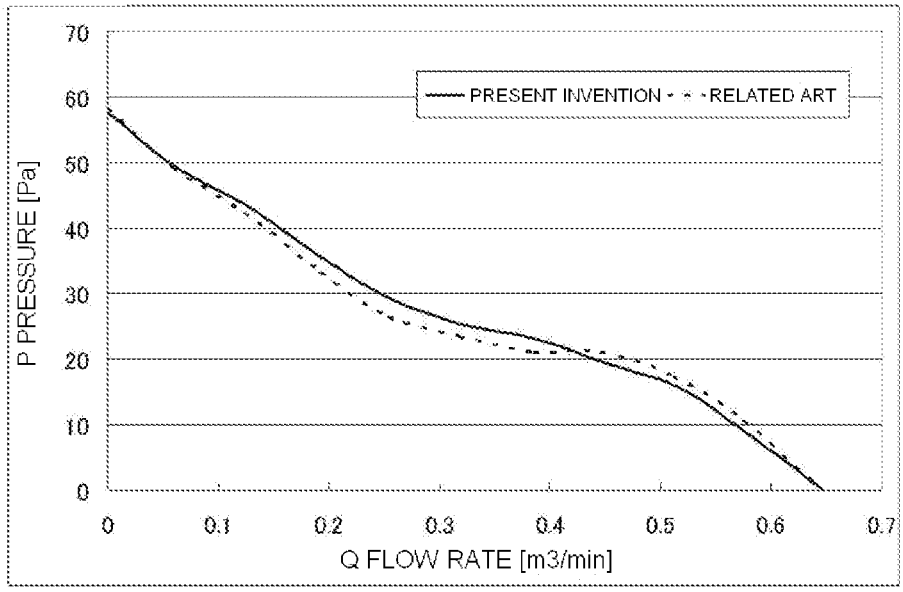
FIG. 12 shows static pressure—flow rate characteristics of an axial fan according to an illustrative embodiment of the present invention and a related-art axial fan.
Figure 13:
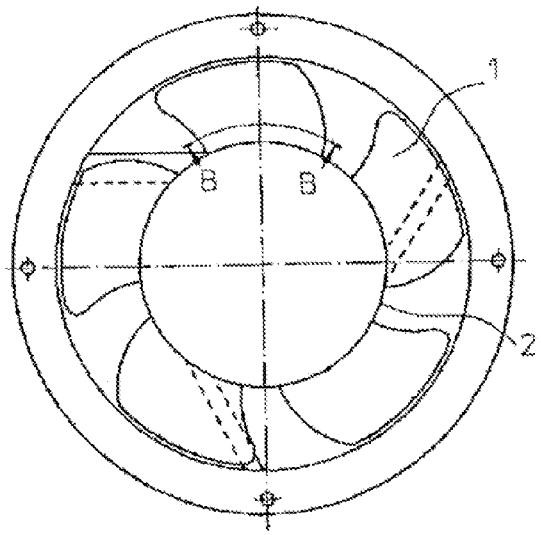
FIG. 13 RELATED ART
FIG. 13 is a front view showing related-art axial fan.
Figure 14:
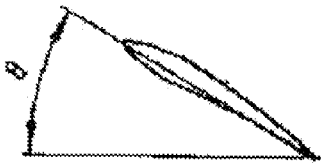
FIG. 14 RELATED ART
FIG. 14 is a sectional view taken along a line B-B of FIG. 13.

FIG. 12 shows static pressure—flow rate characteristics of an axial fan according to an illustrative embodiment of the present invention and a related-art axial fan. A vertical axis indicates the static pressure P and a horizontal axis indicates the flow rate Q. As shown in FIG. 12, according to the related-art axial fan, a so-called surging phenomenon that the static pressure is lowered at a center range of the flow rate is caused, so that the operation of the axial fan is unstable. However, in the axial fan according to an illustrative embodiment of the present invention, the surging phenomenon that occurs in the related-art axial fan is improved. Accordingly, it is possible to provide an axial fan capable of improving the static pressure—flow rate characteristic without causing an unstable operation and further reducing the noise.

While the present invention has been shown and described with reference to certain illustrative embodiments thereof, it will be understood by those skilled in the art that various changes in form and details may be made therein without departing from the spirit and scope of the invention as defined by the appended claims. For example, the cylindrical casing 8 of the housing may be formed at a sidewall with a slit or a hole. In this case, the slit or the hole formed in the sidewall of the cylindrical casing 8 functions as a part of the inlet port. Accordingly, it is possible to increase the air volume and thus to further improve the static pressure—flow rate characteristic.

What is claimed is:

1. An axial fan comprising:

a hub;

an impeller having a plurality of blades mounted on an outer peripheral surface of the hub; and a housing surrounding the impeller, wherein each of the blades has a front edge angle ($\alpha$) within a range of −8° to −20°, a mounting angle ($\beta$) within a range of 36° to 50° , and a twisted angle ($\theta$) within a range of 10°±2°;

wherein the housing includes:

a cylindrical casing;

flanges integrally formed at both ends of the cylindrical casing; and a motor base, wherein the cylindrical casing has an inner wall surface extending from an inlet port toward an outlet port, the inner wall surface including:

first curved surfaces at positions corresponding to corner parts of the flanges in an inlet port side, each of the first curved surfaces being configured by round surfaces at two positions, one of the round surfaces being inwardly inclined;

second curved surfaces at positions corresponding to the corner parts of the flanges in an outlet port side, each of the second curved surfaces being configured by a round surface; and inwardly inclined surfaces at a center part between the inlet port side and the outlet port side such that the inclined surfaces are inwardly inclined as proceeding toward the outlet port, the inwardly inclined surfaces directly connected to respective ends of the inwardly inclined round surfaces; and wherein a gap is formed between the inner wall surface of the casing and an outer peripheral surface of the blade, wherein the gap is gradually decreased throughout from an end of the inlet port of the blade toward an end of the outlet port of the blade so that said gap becomes minimum at an end of the blades on the outlet port side.

2. The axial fan according to claim 1, wherein in each of the blades, the front edge angle ($\alpha$) is within a range of −15° to −20°, and the mounting angle (13) is within a range of 38° to 50°.

3. The axial fan according to claim 1, wherein the cylindrical casing has a plurality of spokes that are connected with the motor base at the outlet port, and wherein the plurality of spokes are arranged at a regular interval in a circumferential direction, each having a cross section of a blade shape and being inclined at a predetermined angle.

4. The axial fan according to claim 1, wherein the cylindrical casing has a sidewall formed with a slit or a hole.

* * * * *